US006170278B1

(12) United States Patent
Jorgensen

(10) Patent No.: US 6,170,278 B1
(45) Date of Patent: Jan. 9, 2001

(54) THERMAL STORAGE RESERVOIR FOR ICE RINK

(76) Inventor: Greg S. Jorgensen, 234 Enfield Crescent, Winnipeg, Manitoba (CA), R2H 1B4

( * ) Notice: Under 35 U.S.C. 154(b), the term of this patent shall be extended for 0 days.

(21) Appl. No.: 09/325,716

(22) Filed: Jun. 4, 1999

(51) Int. Cl.[7] ..... F25C 3/02
(52) U.S. Cl. ..... 62/235; 62/260; 472/92
(58) Field of Search ..... 62/235, 260; 165/45; 472/92

(56) References Cited

U.S. PATENT DOCUMENTS 3,599,441 * 8/1971 Sills ..... 62/235
3,878,694 * 4/1975 Holmsten ..... 62/235
4,089,142 * 5/1978 Kachadorian ..... 62/260
4,467,619 * 8/1984 Kovach ..... 62/235
5,063,748 * 11/1991 Davis et al. ..... 62/260

* cited by examiner

*Primary Examiner*—William E. Tapolcai
(74) *Attorney, Agent, or Firm*—Adrian D. Battison

(57) ABSTRACT

An ice rink is provided having a thermal storage reservoir arranged to regulate the temperature of the ice rink. The ice rink includes a sheet of ice and a sub-floor for supporting the sheet of ice thereon. The reservoir is mounted adjacent a bottom face of the sub-floor. The reservoir is substantially larger in volume than the sheet of ice, being filled with particulate material having a high heat capacity. A fluid surrounds the particulate material having a freezing point which is below that of water. Cooling pipes extending through the reservoir and the sub-floor are arranged to have cooling fluid pumped therethrough for freezing the sheet of ice mounted thereon.

18 Claims, 3 Drawing Sheets

THERMAL STORAGE RESERVOIR FOR ICE RINK

FIELD OF THE INVENTION

This invention relates to a thermal storage reservoir for mounting below an ice surface of an ice rink for regulating a temperature of the ice surface.

BACKGROUND

Conventional indoor ice rinks keep the ice frozen using a refrigeration system below the ice rink floor. Typically the refrigeration system includes a concrete pad directly under the ice having a plurality of refrigerated tubes extending therethrough. The concrete pad is usually about six inches deep and insulated on a bottom face. This system requires constant cooling by the refrigerated tubes. The resulting ice temperature is unstable and highly dependent on the operation of the tubes. This results in the ice melting if a power outage or other temporary interruption of the refrigerated tubes occurs.

SUMMARY

According to one aspect of the present invention there is provided an ice rink comprising;

a sheet of ice;

a sub-floor supporting the sheet of ice thereon;

a cooling system mounted within the sub-floor for controlling a temperature of the sub-floor such that the sheet of ice remains frozen; and a thermal storage reservoir mounted adjacent a bottom face of the sub-floor, the reservoir being filled with a material having a high heat capacity.

Preferably there is provided an insulated layer adjacent a bottom face and a perimeter face of the reservoir.

A heated floor is preferably mounted in the ground spaced below the reservoir for preventing permafrost in the ground below the reservoir. The heated floor may comprise a plurality of heated pipes mounted spaced apart to extend through the ground spaced below the reservoir, the heated pipes being arranged to have heated fluid pumped therethrough. When using a heated floor, a drainage system is preferably mounted in the ground around a periphery of the heated floor for draining ground water under the reservoir.

The reservoir is preferably filled with particulate material, the particulate material being surrounded by fluid. A freezing point depressant may be added to the reservoir for lowering a freezing point of the reservoir below that of water.

Preferably there is provided a set of cooling tubes extending through the reservoir for controlling a temperature of the reservoir. The cooling tubes are preferably mounted parallel and laterally spaced apart throughout the reservoir at a position spaced below a top face of the reservoir towards a bottom face. A portion of the cooling tubes may be positioned adjacent a periphery of the reservoir.

The cooling system of the sub-floor may comprise cooling tubes being arranged to communicate with the cooling tubes extending through the reservoir for passing fluid therebetween to exchange heat between the sub-floor and the reservoir. A layer of insulation may be mounted between the reservoir and the sub-floor when the sub-floor and reservoir are connected by cooling tubes.

According to a further aspect of the present invention there is provided an ice rink comprising;

a sheet of ice;

a thermal storage reservoir supporting the sheet of ice thereon, the reservoir being substantially larger in volume than the sheet of ice;

a mass of particulate material having a high heat capacity filling the reservoir;

a fluid surrounding the particulate material, the fluid having a freezing point below that of water; and a set of cooling tubes extending through the reservoir, the cooling tubes being arranged to have cooling fluid pumped therethrough for controlling a temperature of the reservoir.

Preferably there is provided an insulated layer adjacent a bottom face and a perimeter face of the reservoir.

There may be provided a heated floor spaced below the reservoir for preventing permafrost in the ground below the reservoir. When a heated floor is provided, a drainage system may be mounted in the ground around a periphery of the heated floor for draining ground water under the reservoir.

BRIEF DESCRIPTION OF THE DRAWINGS

In the accompanying drawings, which illustrate an exemplary embodiment of the present invention.

DETAILED DESCRIPTION

Figure 1:
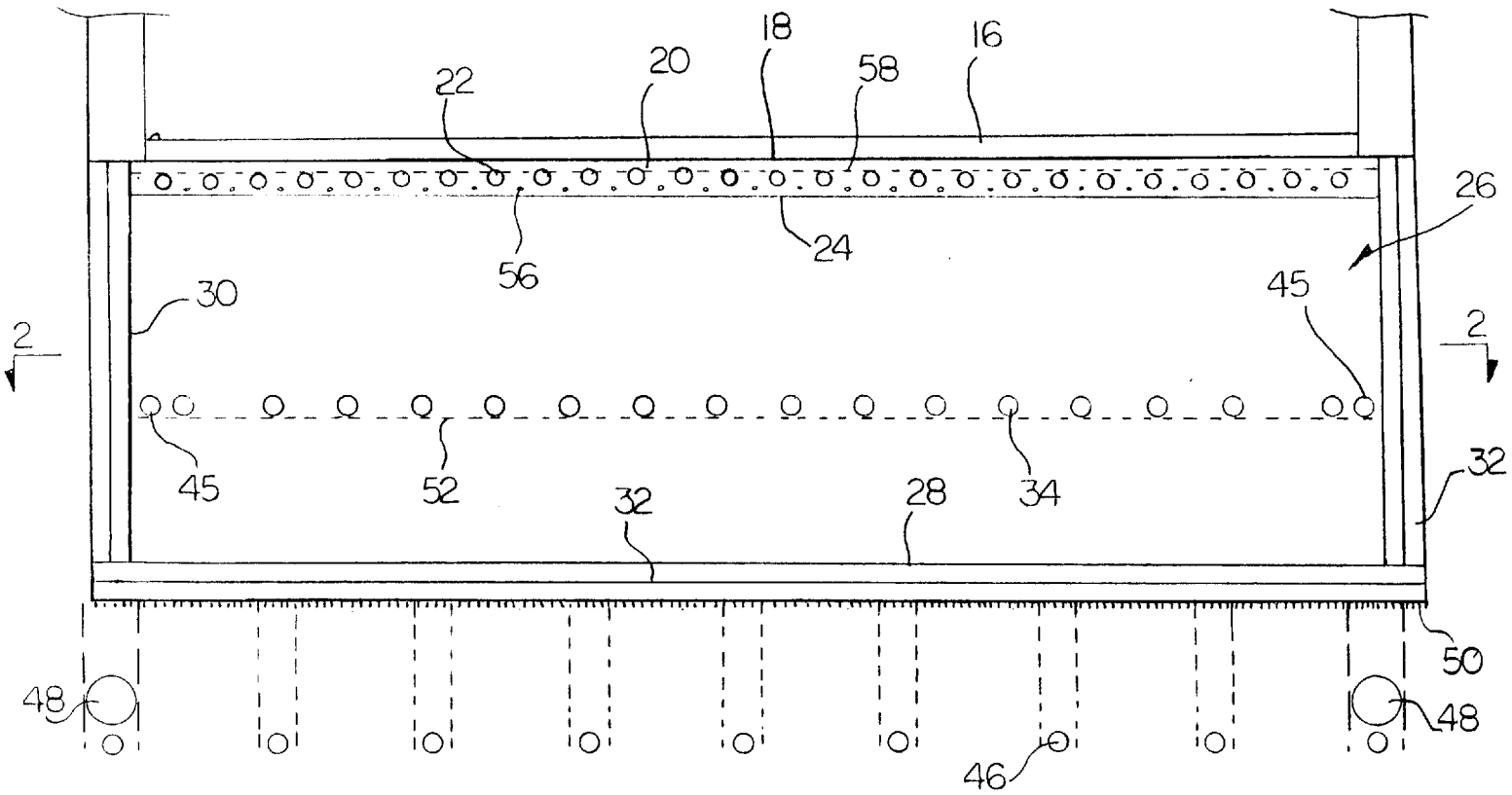
FIG. 1 is an elevational view of a vertical section taken through the ice rink.

Referring to the accompanying drawings, there is illustrated an ice rink generally indicated by the reference numeral 10. The ice rink 10 is housed in a building 12 having a mechanical room 14 for housing heating and refrigeration systems for the building. The ice rink 10 has an ice surface 16 which is generally oval in shape.

Adjacent to a bottom face 18 of the ice surface is a concrete pad 20 forming a sub-floor which has a first set of cooling pipes 22 extending therethrough. The cooling pipes 22 are parallel and laterally spaced apart throughout the pad 20. The first set of cooling pipes 22 are connected to a refrigeration system for cooling the concrete pad 20 and keeping the ice surface frozen. The concrete pad forming the sub-floor is approximately six inches deep while the pipes are approximately one inch in diameter and spaced four inches apart.

Underneath to a bottom face 24 of the concrete pad is a thermal storage reservoir 26. The reservoir 26 is large deposit of sand or gravel being significantly deeper than the concrete pad, extending down into the ground approximately two feet. A bottom face 28 and a periphery 30 of the reservoir 26 are covered with layered of insulation material 32. The insulation 32 ensures that most of the heat exchanged between the reservoir 26 and its surroundings are through a top face of the reservoir adjacent to the bottom face 28 of the concrete pad.

A second set of cooling pipes 34 extend through the reservoir 26. The second set of cooling pipes 34 lie parallel and laterally spaced apart in a horizontal plane spaced from the top face of the reservoir towards the bottom face 28. Each pipe of the second set of cooling pipes 34 is connected at a supply end 36 to a supply header 38 and at a return end 40 to a return header 42. The supply and return headers 38 and 42 are mounted in the mechanical room 14 of the building, spaced from the ice rink.

The second set of cooling pipes 34 are mounted in pairs such that each pair of pipes forms a pair of closed loops which cross over at an looped end 44. The pipes are thus positioned in an alternating pattern between first portions of pipe adjacent to the corresponding supply end 36 and second portions of pipe adjacent to the corresponding return end 40. A peripheral cooling pipe 45 of the second set of cooling pipes 34 is mounted adjacent the periphery of the reservoir. The arrangement of the cooling pipes ensures that the pipes are able to draw heat from the reservoir uniformly across the reservoir.

The second set of cooling pipes 34 are spaced approximately 16 inches below the top face of the reservoir which is approximately two feet deep. The pipes 34 have a diameter of approximately one inch and are spaced approximately twelve inches apart. The second set of cooling pipes 34 are high density geothermal pipes which are arranged to have cold fluid pumped therethrough to freeze the surrounding gravel.

A set of heating pipes 46 are mounted spaced below the insulation 32 which is adjacent to the bottom face 28 of the reservoir. The heating pipes 46 are parallel and laterally spaced apart in the ground below the reservoir. The heating pipes are connected at respective ends to headers in the mechanical room 14. The heating pipes 46 are high density geothermal pipes arranged to have hot fluid pumped through them.

Drainage pipes 48 are buried in the ground below the periphery of the reservoir surrounding the heating pipes for draining any excess ground water. The heating pipes prevent the ground from freezing so it does not heave and damage the reservoir structure. Excess ground water is thus free to flow through the ground and drain through the drainage pipes 48.

In order to install the ice rink, the ground is first excavated down to a level 50 corresponding to the finished location of the insulation 32 adjacent to the bottom face of the reservoir. The excavated area defines the shape and size of the reservoir 26. The heating pipes 46 and draining pipes 48 are then trenched into the ground below the level 50. The trenches are then back filled and levelled flat enough to mount the layered insulation 32 in sheets thereon. The insulation 32 is also set in upright sheets around the periphery of the excavated area.

Figure 2:
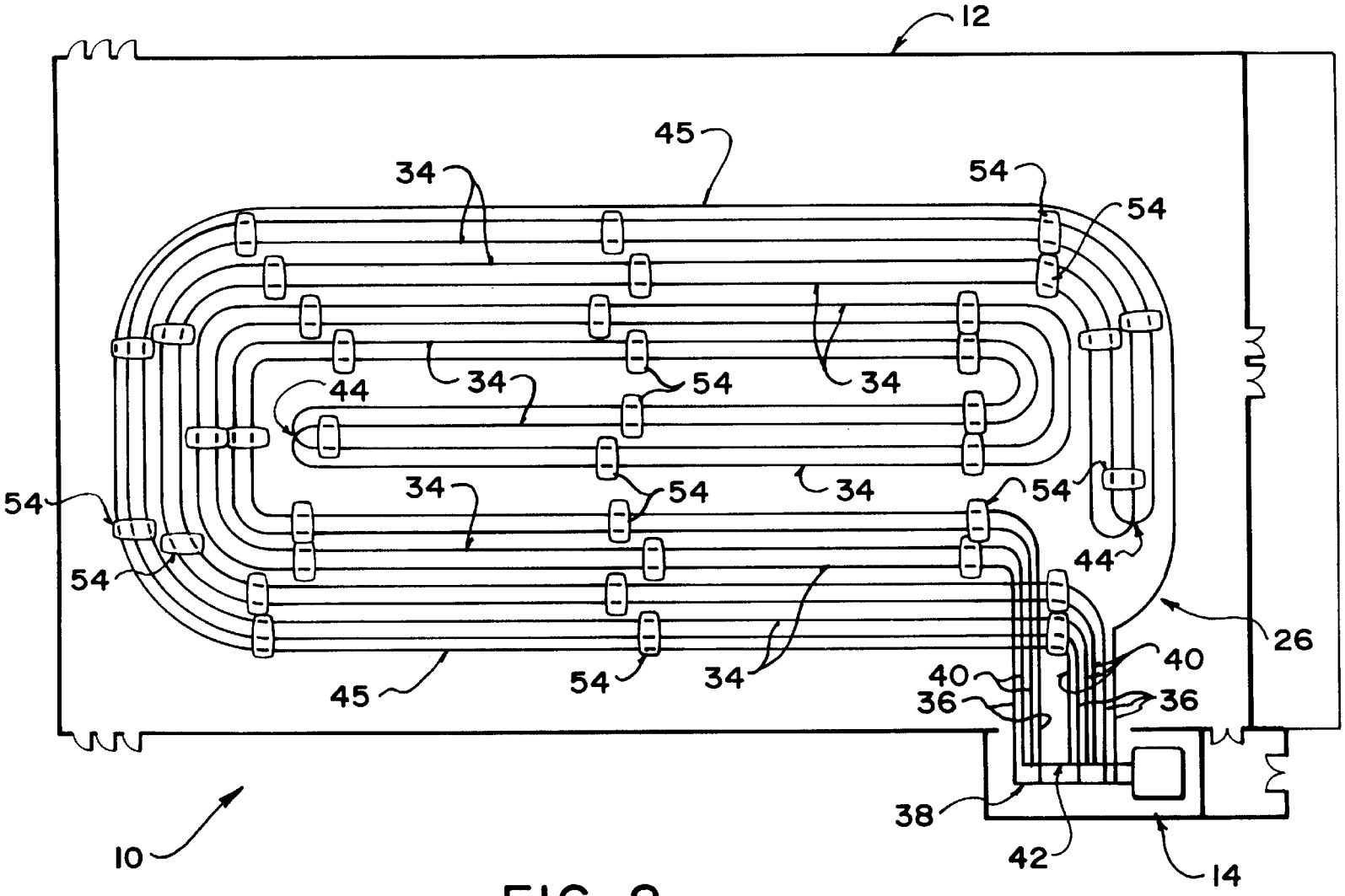
FIG. 2 is a top plan view of the ice rink along the line 2—2 of FIG. 1.

The reservoir 26 is filled with gravel part way to a second level 52 and packed. The second set of cooling pipes 34 are then laid out in the manner as shown in FIG. 2. Sandbags 54 are used to secure the pipes 34 in place before the reservoir is completely filled with the gravel.

Once the gravel is levelled and packed, reinforcement bars 56 are laid out across the top of the reservoir. The first set of cooling pipes 22 are placed on top of and tied to the reinforcement bars 56. The first set of cooling pipes are arranged in a pattern similarly to that shown in FIG. 2 for the second set of cooling pipes. A sheet of wire mesh 58 is secured across a top side of the cooling pipes 22 for securing the pipes in place while the concrete pad 20 is formed.

The concrete is poured on to the top side of the reservoir and surrounds the reinforcement bars and the first set of cooling pipes to form the concrete pad 20. The concrete is levelled and set to complete the rink floor.

In operation, sufficiently cold fluid is pumped through the cooling pipes to freeze the sheet of ice on the top surface of the concrete pad 20. Unlike conventional ice rinks which insulate right under the concrete pad and require constant refrigeration, the thermal storage reservoir 26 includes a large volume of frozen material having a high heat capacity for absorbing large amounts of heat and maintaining the ice surface frozen even if the cooling pipes are temporarily inoperable.

The reservoir 26 thus provides even and stable ice surface temperatures with a higher tolerance for power outages without the ice surface melting. The reservoir arrangement also reduces the need for large short period refrigeration. A smaller refrigeration plant can run for longer periods to build up refrigeration for the high peak times. This system can run during non peak periods of less expensive power to build up the refrigeration required during peak periods. If enough refrigeration is stored then the refrigeration pump can shut down during peek expensive power periods.

Figure 3:
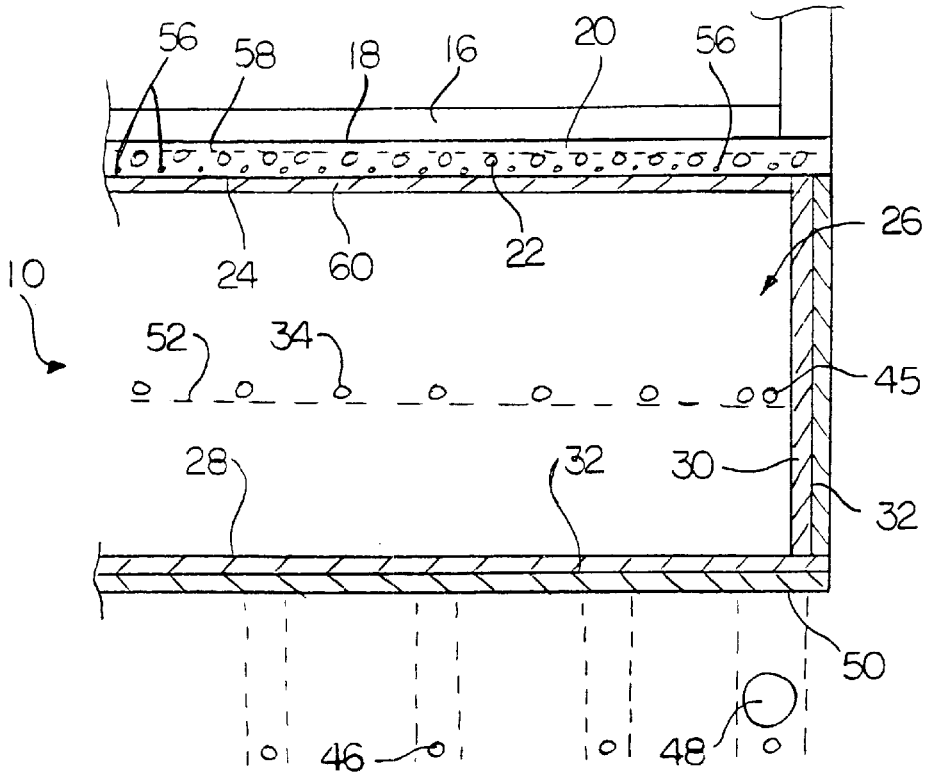
FIG. 3 is an elevational view of a second embodiment of the ice rink having an added layer of insulation.

In an alternative arrangement, as shown in FIG. 3, the top face of the reservoir has an upper layer 60 of insulation mounted thereon. The upper layer of insulation permits the concrete pad 20 to be kept at a different temperature than the reservoir 26. When the upper layer 60 of insulation is installed the reservoir forms a cold storage having a temperature which is independent of the concrete pad above it. The transfer of heat between the concrete pad 20 and the reservoir 26 is accomplished by connecting respective ends of the first and second sets of cooling pipes 22 and 34 for circulating fluid therebetween.

The surface ice 16 can be melted or frozen independent of the reservoir 26. This allows for quick ice turn around for use of the ice rink with the ice surface frozen thereon or without the ice surface such that the concrete pad is bare. The reservoir 26 can thus be kept frozen while the top face of the concrete pad 20 is kept warm. The ice surface can later be quickly frozen on top of the concrete again, by circulating the fluid in the cooling pipes from the reservoir to the concrete pad. The reservoir can also be used for air conditioning of the building without condensation on the concrete pad when no ice surface is desired.

Figure 4:
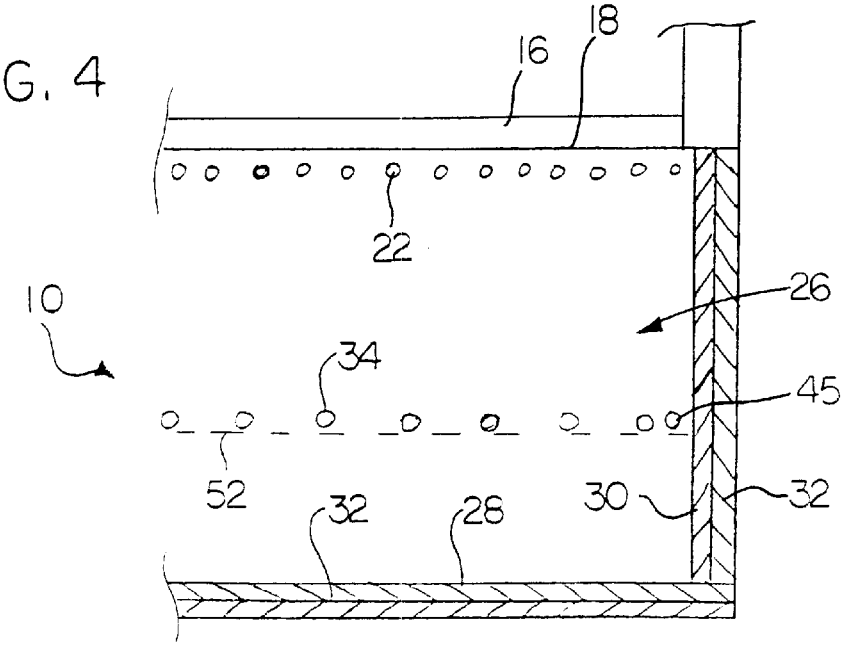
FIG. 4 is an elevational view of a third embodiment of the ice rink wherein the ice surface is adjacent a top face of the reservoir.

In a further arrangement as shown in FIG. 4 the concrete pad 20 is omitted so that an upper part of the deposit or layer of particulate material forms the sub-floor and the ice surface 16 is frozen adjacent a top face of the sub-floor. The first set of cooling pipes 22 are embedded into the top face of the sub-floor 26.

In another arrangement, the reservoir 26 is lined and soaked with a freezing point depressant such as a salt solution or a glycol solution. The freezing point depressant acts to lower the freezing point of the fluid in the reservoir which represents approximately twenty to thirty percent of the volume of the reservoir. Lowering the freezing point of the reservoir below that of water will hold the ice on the surface of the reservoir even if the reservoir is undergoing the process of melting. The reservoir will require its latent heat to be removed at a lower freezing point in order to freeze it when a freezing point depressant is used; however, the lower freezing point is advantageous when the cooling pipes are inoperable as it requires the material in the reservoir to completely melt at a freezing point lower than water before the ice surface even begins to melt. The freezing point depressant can be mixed in with the sand or gravel in the reservoir at the time of construction or it can be soaked into an already formed reservoir by pumping the freezing point depressant in solution into the reservoir.

While some embodiments of the present invention have been described in the foregoing, it is to be understood that other embodiments are possible within the scope of the invention. The invention is to be considered limited solely by the scope of the appended claims.

What is claimed is:

1. An ice rink comprising:

a sheet of ice;

a sub-floor having a horizontal upper surface supporting the sheet of ice thereon;

a cooling system mounted within the sub-floor for controlling a temperature of the sub-floor such that the sheet of ice remains frozen; and a thermal storage reservoir mounted underneath a bottom face of the sub-floor having a bottom surface resting on the ground, the reservoir being filled with a material having a high heat capacity; and a set of cooling tubes extending through the reservoir for controlling a temperature of the reservoir.

2. The ice rink according to claim 1 wherein there is provided a layer of an insulating material underneath a bottom face of the reservoir.

3. The ice rink according to claim 1 wherein there is provided a layer of an insulating material around a perimeter face of the reservoir.

4. The ice rink according to claim 1 wherein there is provided a heating system for heating the ground below the reservoir for preventing permafrost in the ground below the reservoir.

5. The ice rink according to claim 4 wherein the material having high heat capacity comprises a particulate material surrounded by fluid having a freezing point depressant added thereto for lowering a freezing point of the reservoir below that of water.

6. The ice rink according to claim 1 wherein the cooling system in the sub-floor comprises cooling tubes and wherein the cooling tubes in the sub-floor are arranged to communicate with the cooling tubes extending through the reservoir for passing fluid therebetween to exchange heat between the sub-floor and the reservoir.

7. The ice rink according to claim 1 wherein there is provided a layer of an insulating material between the reservoir and the sub-floor.

8. An ice rink comprising;

a sheet of ice;

a horizontal support surface on which the sheet of ice is supported;

a thermal storage reservoir underneath the support surface supporting the sheet of ice thereon, the reservoir having a bottom surface resting on the ground and being substantially larger in volume than the sheet of ice;

a mass of particulate material having a high heat capacity filling the reservoir;

a fluid surrounding the particulate material, the fluid having a freezing point below that of water; and a set of cooling tubes extending through the reservoir, the cooling tubes being arranged to have cooling fluid pumped therethrough for controlling a temperature of the reservoir.

9. The ice rink according to claim 8 wherein there is provided a layer of an insulating material between the bottom face of the reservoir and the ground.

10. The ice rink according to claim 8 wherein there is provided a layer of an insulating material around a perimeter face of the reservoir.

11. The ice rink according to claim 8 wherein there is provided a heating system for heating the ground below the reservoir for preventing permafrost in the ground below the reservoir.

12. An ice rink comprising;

a sheet of ice;

a horizontal sub-floor having an upper support surface on which the sheet of ice is supported, the sub-floor having a thickness and construction arranged to provide a support for the sheet of ice;

a thermal storage reservoir underneath the sub-floor, the reservoir having a bottom surface resting on the ground and being substantially larger in volume than the sub-floor;

the reservoir being filled by a mass of particulate material having a high heat capacity; and a set of cooling tubes extending through the reservoir, the cooling tubes being arranged to have cooling fluid pumped therethrough for controlling a temperature of the reservoir.

13. The ice rink according to claim 12 wherein there is provided a layer of an insulating material underneath a bottom face of the reservoir.

14. The ice rink according to claim 12 wherein there is provided a layer of an insulating material around a perimeter face of the reservoir.

15. The ice rink according to claim 12 wherein there is provided a heating system for heating the ground below the reservoir for preventing permafrost in the ground below the reservoir.

16. The ice rink according to claim 12 wherein the material having high heat capacity comprises a particulate material surrounded by fluid having a freezing point depressant added thereto for lowering a freezing point of the reservoir below that of water.

17. The ice rink according to claim 12 wherein the cooling system in the sub-floor comprises cooling tubes and wherein the cooling tubes in the sub-floor are arranged to communicate with the cooling tubes extending through the reservoir for passing fluid therebetween to exchange heat between the sub-floor and the reservoir.

18. The ice rink according to claim 1 wherein there is provided a layer of an insulating material between the reservoir and the sub-floor.

* * * * *

Disclaimer 6,170,278—Greg S. Jorgensen, Winnipeg Canada. THERMAL STORAGE RESERVOIR FOR ICE RINK. Patent dated January 9, 2001. Disclaimer filed by attorney, Michael R. Williams.

Hereby enter this disclaimer to claims 1-6.

*(Official Gazette, July 16, 2002)*